US007156930B2

(12) United States Patent
Kashiwazaki et al.

(10) Patent No.: US 7,156,930 B2
(45) Date of Patent: Jan. 2, 2007

(54) ALUMINUM ALLOY PIPE HAVING MULTISTAGE FORMABILITY

(75) Inventors: Kazuhisa Kashiwazaki, Tokyo (JP); Ryo Shoji, Tokyo (JP); Hisashi Tamura, Tokyo (JP)

(73) Assignee: Furukawa-Sky Aluminum Corporation, Tokyo (JP)

( * ) Notice: Subject to any disclaimer, the term of this patent is extended or adjusted under 35 U.S.C. 154(b) by 58 days.

(21) Appl. No.: 10/353,058

(22) Filed: Jan. 29, 2003

(65) Prior Publication Data

US 2003/0164207 A1 Sep. 4, 2003

(30) Foreign Application Priority Data

Feb. 5, 2002 (JP) ..... 2002-027734
Nov. 15, 2002 (JP) ..... 2002-332921

(51) Int. Cl.
*C22C 21/00* (2006.01)

(52) U.S. Cl. ..... 148/440; 420/542; 420/543

(58) Field of Classification Search ..... 148/440; 420/542, 543; 138/177
See application file for complete search history.

(56) References Cited

U.S. PATENT DOCUMENTS

| | | | | |
|---|---|---|---|---|
| 4,437,679 | A * | 3/1984 | Campagnolo | 280/281.1 |
| 6,221,182 | B1 | 4/2001 | Barlat et al. | 148/439 |
| 6,764,559 | B1 * | 7/2004 | Li et al. | 148/523 |
| 2001/0050118 | A1 | 12/2001 | Raynaud | 148/439 |

FOREIGN PATENT DOCUMENTS

| | | | |
|---|---|---|---|
| EP | 0 681 034 | | 11/1995 |
| JP | 59-185520 | | 10/1984 |
| JP | 61-52344 | | 3/1986 |
| JP | 61052344 | A * | 3/1986 |
| JP | 5-295495 | | 11/1993 |
| JP | 6-226339 | | 8/1994 |
| JP | 8-108237 | | 4/1996 |
| JP | 8-168814 | | 7/1996 |
| JP | 8-311594 | | 11/1996 |
| JP | 9-38717 | | 2/1997 |
| JP | 9-67634 | | 3/1997 |
| JP | 11-80875 | | 3/1999 |
| JP | 11-104751 | | 4/1999 |
| JP | 11-293375 | | 10/1999 |

OTHER PUBLICATIONS

Glazkov, V.I. "Possible deformation during espansion and heat flanging", abstract.*
Concise Explanation of Documents AC-AG.

* cited by examiner

*Primary Examiner*—Roy King
*Assistant Examiner*—Janelle Morillo
(74) *Attorney, Agent, or Firm*—Westerman, Hattori, Daniels & Adrian, LLP.

(57) ABSTRACT

An aluminum alloy pipe, which is composed of an aluminum alloy containing 2.0% (% by mass, the same hereinafter) to 5.0% of Mg, 0.20% or less of Si, 0.30% or less of Fe, 0.8% or less (including 0%) of Mn, 0.35% or less (including 0%) of Cr, and 0.2% or less (including 0%) of Ti, with the balance being Al and inevitable impurities, wherein the aluminum alloy pipe has a 0.2% yield strength of 60 MPa or more and 160 MPa or less and an average crystal grain diameter of 150 μm or less, and wherein the aluminum alloy pipe has multistage formability.

20 Claims, 4 Drawing Sheets

ALUMINUM ALLOY PIPE HAVING MULTISTAGE FORMABILITY

FIELD

The present invention relates to an aluminum (optionally abbreviated as Al hereinafter) alloy pipe, which is excellent in multistage formability. "Multistage formability" as used herein refers to formability in the second forming step and the steps thereafter, such as hydraulic bulge forming and pressing, applied after the first forming step, such as bending.

BACKGROUND

A plurality of press-formed materials of steel have been assembled by welding, to be used for automobile frames and the like. In recent years, multistage-formed articles of Al alloy pipes have been used, for the purpose of making the frames or the like into lightweight or modules.

The methods for manufacturing Al alloy pipes are roughly classified into: casting (such as casting and die-casting); and working to make wrought alloys (such as hollow extrusion). An Al alloy pipe manufactured by casting is relatively poor in reliability, since it contains coarse voids or its toughness is low.

An Al alloy pipe manufactured by working to make a wrought Al alloy is used in, for example, front/side frame members of automobiles and frames of motorcycles. Proposed examples of the method for manufacturing an Al alloy pipe using a wrought Al alloy include: (1) applying bending and hydraulic bulge forming to an Al alloy pipe having a circular cross section; (2) applying inner pressure, after bending an Al alloy pipe having a polygonal cross section; and (3) applying pressing and hydraulic bulge forming, by placing an Al alloy pipe in a hydraulic bulge die.

While an Al alloy pipe manufactured by working to make a wrought Al alloy is usually manufactured by mandrel extrusion, as a combination of a die and a mandrel, it can also be manufactured, for example, by port-hole extrusion, by which divided pieces extruded from a port-hole die (a kind of a division die) are fusion welded to form a pipe at the outlet side of the die, or by seam welding, by which the edges of a rolled up sheet are fitted together and welded.

However, there has been such a problem that cracks or the like are liable to be occurred at the bent portions, when a conventional Al alloy pipe as mentioned above is subjected to the second forming step and forming steps thereafter, such as pressing and hydraulic bulge forming, by which the cross sectional shape in the pipe's circumference direction (hereinafter simply abbreviated to "cross sectional shape") is changed, after the first forming step of bending or the like.

Examples of the Al alloys that have been used in the above-mentioned Al alloy pipes include 1000 series Al alloys, such as 1050 and 1100 alloys; 3000 series Al alloys, such as 3003 and 3004 alloys; 5000 series Al alloys, such as 5052, 5454, and 5083 alloys; 6000 series Al alloys, such as 6063, 6N01, and 6061 alloys, and 7000 series Al alloys, such as 7003 and 7N01 alloys. However, these Al alloys each involve such problems as mentioned below: Insufficient mechanical strength and limited uses, as encountered in Al alloy pipes of the 1000 or 3000 series Al alloys; poor multistage formability, as encountered in Al alloy pipes of the 5000 series Al alloys; poor bending property and multistage formability, as encountered in Al alloy pipes made of the hard 6000 series or 7000 series Al alloys; and poor productivity, as encountered in Al alloy pipes made of the soft 6000 series or 7000 series Al alloys, which require aging after multistage forming, due to their low mechanical strength.

SUMMARY

The present invention is an aluminum alloy pipe, which is composed of an aluminum alloy comprising 2.0% (% by mass, the same hereinafter) to 5.0% of Mg, 0.20% or less of Si, 0.30% or less of Fe, 0.8% or less (including 0%) of Mn, 0.35% or less (including 0%) of Cr, and 0.2% or less (including 0%) of Ti, with the balance being Al and inevitable impurities, wherein the aluminum alloy pipe has a 0.2% yield strength of 60 MPa or more and 160 MPa or less and an average crystal grain diameter of 150 μm or less, and wherein the aluminum alloy pipe has multistage formability.

Other and further features and advantages of the invention will appear more fully from the following description, taken in connection with the accompanying drawings.

BRIEF DESCRIPTION OF THE DRAWINGS

The same reference numerals in each drawing denote the same members, respectively. The sizes (e.g. length, thickness) shown in the drawings denote examples of sizes applicable to the present invention, and the present invention is not restricted thereto.

DETAILED DESCRIPTION

Figure 1A:
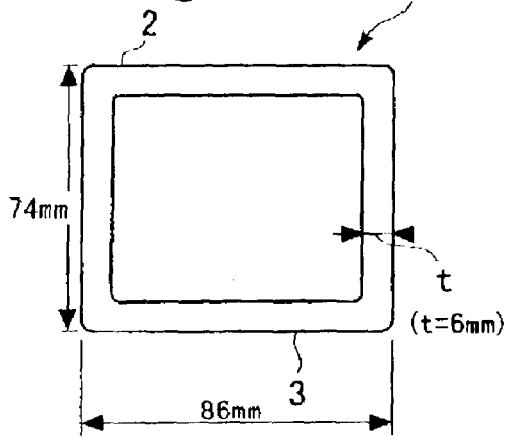
FIGS. 1(A) to 1(E) are cross sectional views of pipes in the pipe's circumference direction showing a variety of embodiments of the Al alloy pipe of the present invention. In the cross sectional view of FIG. 1(A), a side 2 has the same length and thickness as a side 3. The side 2 comes to the outside of a bent portion, and the side 3 comes to the inside of the bent portion, respectively, after bending. In the cross sectional views of FIGS. 1(B), 1(C), and 1(D), any of the sides 2 and 3 and a side 4 connecting these sides 2 and 3 has a different thickness from the others. In the cross sectional view of FIG. 1(E), the side 2 has a length different from the side 3.

According to the present invention, there are provided the following means:

(1) An aluminum alloy pipe, which is composed of an aluminum alloy comprising 2.0% (% by mass, the same hereinafter) to 5.0% of Mg, 0.20% or less of Si, 0.30% or less of Fe, 0.8% or less (including 0%) of Mn, 0.35% or less (including 0%) of Cr, and 0.2% or less (including 0%) of Ti, with the balance being Al and inevitable impurities, wherein the aluminum alloy pipe has a 0.2% yield strength of 60 MPa or more and 160 MPa or less and an average crystal grain diameter of 150 μm or less, and wherein the aluminum alloy pipe has multistage formability;

(2) An aluminum alloy pipe, which is composed of an aluminum alloy comprising 2.0% to 3.5% of Mg, 0.10% or less of Si, 0.15% or less of Fe, 0.8% or less (including 0%) of Mn, 0.35% or less (including 0%) of Cr, and 0.2% or less (including 0%) of Ti, with the balance being Al and inevitable impurities, wherein the aluminum alloy pipe has a 0.2% yield strength of 60 MPa or more and 140 MPa or less and an average crystal grain diameter of 150 μm or less, and wherein the aluminum alloy pipe has multistage formability;

(3) The aluminum alloy pipe according to the above item (1) or (2), wherein a distribution density of an intermetallic compound with a maximum length of 5 μm or more is $500/mm^2$ or less;

(4) The aluminum alloy pipe according to any one of the above items (1) to (3), which has no welded portion;

(5) The aluminum alloy pipe according to any one of the above items (1) to (4), wherein a thickness of a pipe wall at a portion that comes to the outside after bending is larger than a thickness of a pipe wall at a portion that comes to the inside after bending, in a cross section of the pipe in a pipe's circumference direction;

(6) The aluminum alloy pipe according to any one of the above items (1) to (5), wherein a wall surface that comes to the inside after bending, and a wall surface that comes to the outside after bending, each have an approximately linear side, and wherein a length of the side at a portion that comes to the outside after bending, is longer than a length of the side at a portion that comes to the inside after bending, in a cross section of the pipe in a pipe's circumference direction; and (7) The aluminum alloy pipe according to any one of the above items (1) to (6), which is flanged.

The inventors found, through intensive studies on the multistage formability of Al alloys, that the multistage formability of Al—Mg-series alloys can be improved, by adjusting the 0.2% yield strength and average crystal grain diameter of hollow extruded materials within a prescribed range, respectively. The inventors have completed the present invention through additional intensive studies based on this finding.

The elements in the alloy of the Al alloy pipe of the present invention will be described hereinafter.

In the present invention according to the above item (1), Mg can contribute to improve mechanical strength, by forming a solid solution of Mg. The content of Mg is defined to be within the range of 2.0 to 5.0%. This is because, when the content of Mg is less than 2.0%, mechanical strength (0.2% yield strength) required for a structure member of transport vehicles cannot be sufficiently ensured; and, when the content of Mg exceeds 5.0%, cracks tend to be occurred during multistage forming, and decreasing the resistance against stress corrosion cracking.

In particular, since stress corrosion cracking tends to occur when the aluminum alloy pipe is used for a suspension or a member around thereof of automobiles at which position a working temperature exceeds 60° C., the upper limit of the Mg content is preferably 3.5%. Accordingly, the preferable content of Mg is in the range of 2.0 to 3.5%. The preferable Mg content, considering both mechanical strength and resistance against stress corrosion cracking, is 2.4 to 3.0%.

Mn and Cr improve mechanical strength, while suppressing occurring of giant recrystallized grains.

Multistage formability becomes poor due to formation of a giant intermetallic compound (primary crystals) of any of Al—Mn-based and Al—Cr-based when the contents of Mn and Cr are too large. Accordingly, the content of Mn is defined to be 0.8% or less, and the content of Cr is defined to be 0.35% or less. Further, the content of Mn is preferably 0.60% or less and the content of Cr is preferably 0.25% or less, respectively, for manufacturing the pipes by extrusion, since Mn and Cr may decrease extrusion suitability, and Al—Mg—Mn-based or Al—Cr-based intermetallic compound(s) may affect multistage formability when the forming (working) ratio is high in multistage forming.

In the present invention according to the item (1) above, preferably, mechanical strength is improved by adding Mg, and manufacturing conditions in, for example, extruding, rolling and annealing, are preferentially selected to prevent the recrystallized grains from being giant, as well as Mn and Cr are optionally added, if necessary.

It is preferable to add Ti, since Ti is effective for making the texture of an ingot fine, for enhancing casting ability and hot-working ability, for making mechanical properties of a resulting article uniform, and for preventing cracks from occurring during welding.

The content of Ti is defined to 0.2% or less, since formability decreases, by forming a giant intermetallic compound (primary crystals), when the content of Ti exceeds 0.2%. On the other hand, the content of Ti is preferably 0.001% or more, particularly preferably 0.01% or more, since the effect for making the texture fine becomes insufficient when the content of Ti is too small. Adding B together with Ti is preferable to accelerate the texture to be fine, but the effect of B is saturated when the amount of addition of B is too large, with an increase of the production cost. Accordingly, the amount of addition of B when added, is preferably 0.02% or less.

In the present invention according to the item (1) above, the 0.2% yield strength of the Al alloy pipe is defined to be 60 to 160 MPa. This is because mechanical strength sufficient for use for structural members of transport vehicles cannot be obtained when the 0.2% yield strength is less than 60 MPa, while multistage formability decreases when the 0.2% yield strength exceeds 160 MPa.

The 0.2% yield strength is preferably in the range of 60 to 140 MPa, and particularly preferable in the range of 80 to 120 MPa.

In the present invention according to the item (1) above, the average crystal grain diameter of the Al alloy in the pipe is defined to 150 μm or less. This is because when the average crystal grain diameter exceeds 150 μm, a rough surface tends to appear in the first stage of forming, and cracks tend to be occurred in the second stage of forming and the subsequent stages. Accordingly, the particularly preferable crystal grain diameter is 100 μm or less. While the lower limit of the average crystal grain diameter is not particularly restricted, it is generally 20 μm or more.

The crystal grain diameter may be controlled by selecting the conditions, for example, in extruding, rolling, and annealing. For example, when the degree of strain (working ratio) is increased in the extruding step or rolling step, it is possible to make the crystal grain diameter small in the succeeding annealing step.

For example, when the crystal grain diameter is to be controlled at the time of extruding, it is preferable, to make the crystal grains fine, to adjust the extrusion ratio (the ratio between the cross-sectional area of a billet and the cross-sectional area of the extruded pipe) to be 30 or more.

The contents of Si and Fe as impurity elements are defined in the present invention according to the item (1) above.

Si and Fe are impurity elements contained in the raw materials, such as ingots and scrap, and they form intermetallic compounds of Al—Fe-based, Al—Fe—Si-based, Al—Si-based, Mg—Si-based or the like. The intermetallic compounds become giant, to decrease multistage formability, when the contents of Si and Fe are too large.

Accordingly, the content of Si is defined to 0.20% or less and the content of Fe is defined to 0.30% or less, respectively, in the present invention according to the item (1) above. Particularly, the content of Si is preferably 0.02% or more and 0.10% or less, and the content of Fe is preferably 0.05% or more and 0.15% or less.

The present invention according to the item (2) above is the same as the present invention according to the item (1) above, except for defining to have 2.0 to 3.5% of Mg, 0.10% or less of Si, and 0.15% or less of Fe, and 60 to 140 MPa of the 0.2% yield strength, respectively, in the preferable ranges thereof.

In the present invention according to the items (1) and (2), the permissible contents of elements mixed as impurities, other than the above-mentioned Si and Fe, are preferably 0.15% or less for Cu, 0.25% or less for Zn, and 0.05% or less for a respective impurity element other than those.

The present invention according to the item (3) above is a preferable embodiment of the present inventions according to the item (1) or (2) above, in which a distribution density of an intermetallic compound having a maximum length of 5 μm or more in the Al alloy pipe, is defined to a preferable value of 500/mm$^2$ (number per square millimeter) or less. An intermetallic compound having a maximum length of 5 μm or more is peeled off from a matrix by bending, to occur fine cracks. These fine cracks may be readily propagated in the second stage of forming and thereafter, and grow into macroscopic cracks, when the number of intermetallic compounds with a maximum length of 5 μm or more is too large. Too large a number of such intermetallic compounds may deteriorate bulge formability. Accordingly, the distribution density of an intermetallic compound with a maximum length of 5 μm or more, is preferably 300/mm$^2$ or less. The lower limit of the distribution density is not particularly restricted, but it is generally 10/mm$^2$ or more.

Examples of the intermetallic compound described above include intermetallic compounds of Al—Mn-based, Al—Cr-based, Al—Fe-based, Al—Fe—Si-based, Mg—Si-based, Al—Fe—Mn—Si-based, or Al—Ti-based.

The distribution state of the intermetallic compound as described above can be attained by properly adjusting the contents of Mn, Cr, Fe, Si, Mg, Ti, and the like, and properly setting the manufacturing conditions (e.g. casting conditions, an extrusion ratio) in each manufacturing step.

For Example, casting is preferably performed by semi-continuous casting by cooling with water, and extrusion is preferably preformed with an extrusion ratio of about 20 or more.

The Al alloy pipe of the present invention can be manufactured by the steps, for example, of: (1) billet casting→homogenizing→pipe extruding→annealing; (2) billet casting→homogenizing→pipe extruding→annealing→drawing→annealing; or (3) slab casting→homogenizing→rolling→annealing→seam welding→annealing.

The homogenizing is applied for the purpose to improve extruding ability, by allowing the alloying elements forming a supersaturated solid solution in the casting step to precipitate, and to improve the mechanical strength and formability of the resulting product, as well as to reduce irregularity in qualities among the products, by eliminating microscopic segregation of the alloying elements, and by homogenizing the distribution of the elements in the alloy. The homogenizing conditions are sufficient, for example, to heat to a temperature within the range of 430 to 580° C. for a time period of about 1 to 48 hours, as usually applied to 5000 series alloys. In this connection, however, productivity becomes poor when the heating temperature is too low, due to a long period of time required for homogenization, as well as recrystallization is interfered in the extruding or rolling step, due to a too-fine precipitate of Mn or the like, which results in that the crystal grains tend to be giant. Too high of a temperature is also not preferable, on the other hand, since a part of the ingot becomes blistered or melted, particularly when the content of Mn exceeds 4%. Accordingly, the homogenizing is preferably carried out at 480 to 560° C. for 1 to 8 hours, to the alloys according to the present invention.

The alloys are extruded by heating the extrusion billet after completing homogenizing, for example, at 400 to 540° C. again, as is usually performed in 5000 series alloys. The deformation resistance of the billet becomes high when the re-heating temperature (extrusion temperature) is too low, thereby decreasing the extrusion speed, in addition to reducing productivity, making the extrusion process impossible in some cases. It is not preferable, on the other hand, for the temperature to be too high, since the surface becomes roughened and, in extreme cases, becomes locally melted. The extrusion ratio (the value obtained by dividing the cross-sectional area of the billet before extrusion, by the cross-sectional area of the extruded article) is usually in the range of 10 to 170 in 5000 series alloys. The crystal grains after extrusion tend to be giant when the extrusion ratio is low, due to insufficient extrusion strain applied. When the extrusion ratio is too high, on the other hand, the extrusion speed decreases, to reduce productivity. The preferable extrusion temperature and extrusion ratio are in the ranges, respectively, of 480 to 530° C., and 25 to 150, in the present invention.

Since the extruded pipe has already been recrystallized when the temperature at the outlet side of an extruder for the pipe is at the recrystallization temperature or a higher temperature in the methods (1) and (2) above, it is possible to omit the succeeding annealing, to form into a so-called H112-temper alloy. This method is preferable when improved productivity is required.

The recrystallization temperature is in the range of 280 to 330° C. in the alloy as defined in the present invention.

In summary, the Al alloy pipe of the present invention includes extruding finish pipes, drawing finish pipes, and seam welding finish pipes, when these satisfy the values defined in the present invention, such as 0.2% yield strength and the average crystal grain diameter.

Figure 3A:
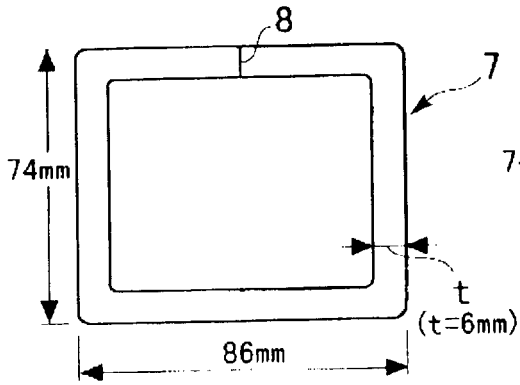
FIGS. 3(A) and 3(B) are cross sectional views of pipes in the pipe's circumference direction showing further another embodiments of the Al alloy pipe of the present invention having a welded portion(s) in the pipe. The pipe shown in FIG. 3(A) is manufactured by seam welding, and the pipe shown in FIG. 3(B) is manufactured by porthole extrusion.
Figure 3B:
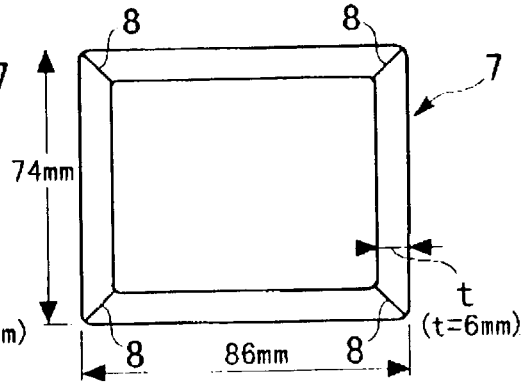

The Al alloy pipes manufactured according to the methods in (1) or (2) above have no fused portions, i.e. no welded portions. On the other hand, the alloy pipes manufactured according to the method in (3), that is, an Al alloy pipe 7 manufactured by seam welding or porthole extrusion, have a fused portion(s) 8, as shown in FIGS. 3(A) and 3(B).

The present invention according to the item (4) above is an Al alloy pipe having no fused portions, as shown in FIG. 1(A). Microscopic cracks can be prevented from occurring which may appear on fused portions, when bending, because the Al alloy pipe has no fused portions. The microscopic cracks progress into macroscopic cracks in the succeeding second stage forming, by which the cross-sectional shape of the pipe is changed. The microscopic cracks are occurred using defects, such as an oxide film or a blowhole, in the fused portions as nuclei. However, no defects are occurred in the Al alloy pipe according to the present invention as describe in the above item (4), since the pipe has no fused portions. The Al alloy pipe 1, free of fused portions, can be manufactured according to mandrel extrusion in a usual manner.

In the present invention, preferably, the cross-sectional shape of the Al alloy pipe in the pipe's circumference direction is formed to resemble the shape and size of the final product. This is because, for example, when the final cross section to be formed by the second stage forming after bending is rectangular, the number of working steps and an amount to be worked in the second stage and thereafter are more reduced as well as little trouble of cracks or the like is occurred, by using an Al alloy pipe having a rectangular cross section that resembles the size of the final product, than by using an Al alloy pipe having a circular cross section.

In the present invention, plastic-working ability after bending can be further improved with an increase of rigidity in a specific direction, by devising the cross-sectional shape of the Al alloy pipe in the pipe's circumference direction.

Figure 1B:
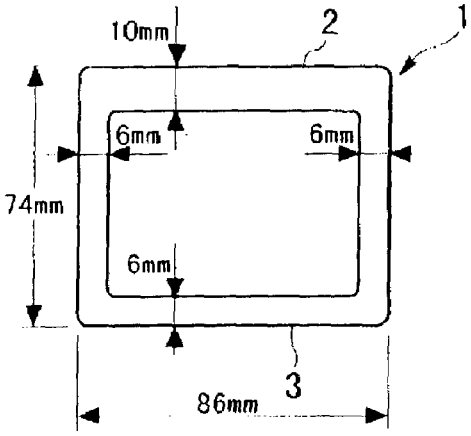

In the present invention according to the item (5) above, as shown in FIG. 1(B), the thickness of a portion (side) 2 that comes to the outside after bending of the Al alloy pipe, is made to be larger than a portion (side) 3 that comes to the inside after bending, to permit the thickness at the outside of the bent portion to be approximately equal to the thickness at the inside of the bent portion after bending. Consequently, the forming limit in the hydraulic bulge forming for enlarging the circumference length of the bent portion, is improved.

Figure 1C:
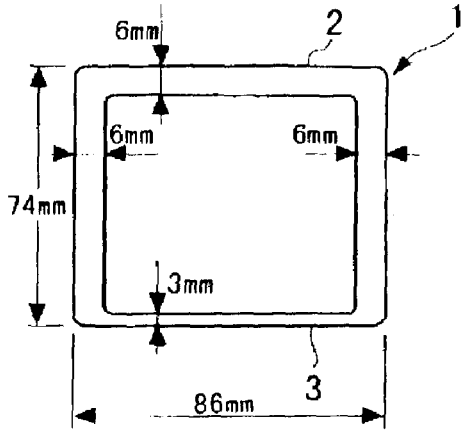

As shown in FIG. 1(C), the portion (side) 3 that comes to the inside after bending is thinned, to allow the outside of the bent portion to have approximately the same thickness as the inside of the bent portion after bending. Consequently, a prescribed hydraulic bulge formability is maintained in the hydraulic bulge forming to expand the circumference length of the bent portion, as well as permitting such advantages as the Al alloy pipe to be lightweight and the bending radius to be small, since the portion (side) 3 that comes to the inside after bending has a smaller thickness.

Figure 1D:
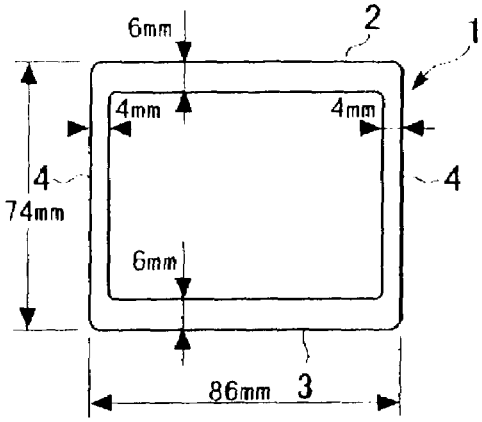

As shown in FIG. 1(D), when the thickness of a side 4, as the right or left side, or as a portion (side) connecting sides 2 and 3, after bending, is thinned, bending ability, hydraulic bulge formability, and rigidity in the horizontal direction can be maintained, as well as permitting the Al alloy pipe to be lightweight, due to the small thickness of the left and right sides 4.

Figure 1E:
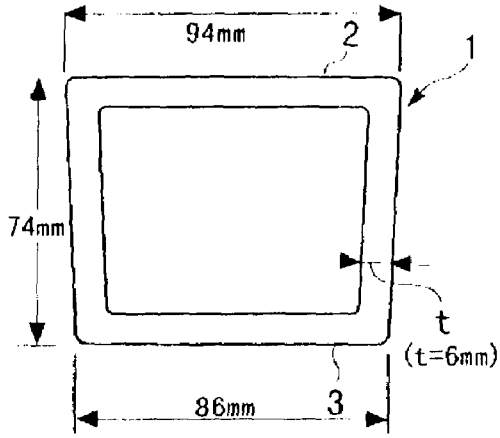

In the present invention according to the item (6) above, as shown in FIG. 1(E), the portion (side) 2 that comes to the outside after bending is made to be longer than the portion (side) 3 that comes to the inside after bending, so that the thickness of the side that comes to the outside at the bent portion after bending is approximately equal to the thickness of the side that comes to the inside at the bent portion after bending, to attain the same effects as the pipe shown in FIG. 1(B).

Figure 2A:
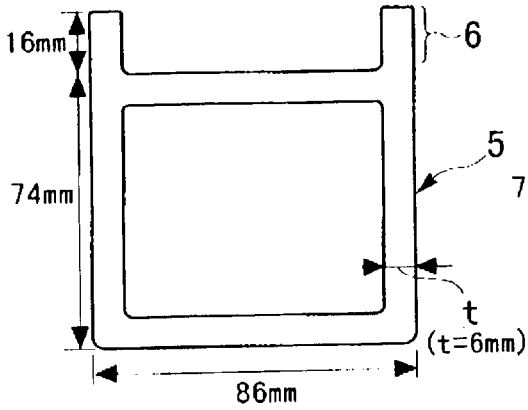
FIGS. 2(A) and 2(B) are cross sectional views of pipes in the pipe's circumference direction showing another embodiments of the Al alloy pipe of the present invention, in which each pipe is flanged.
Figure 2B:
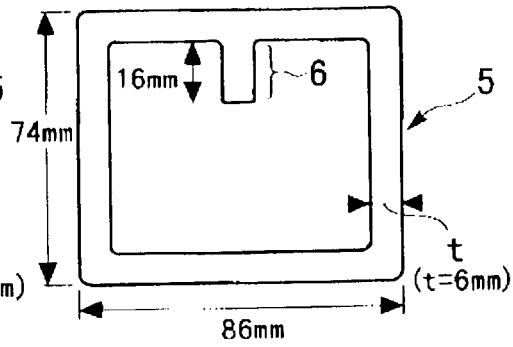

In the present invention, as shown in FIGS. 2(A) and 2(B), a flange 6 is formed on the outside or inside of an Al alloy pipe 5, to suppress wrinkling at the bent portion from occurring, to obtain a beautiful outer appearance. Assembly of various parts may be facilitated by taking advantage of washer attachment holes or the like (not shown), by providing them on the flange 6.

The Al alloy pipes having the cross-sectional shape shown in any of FIGS. 1(A) to 1(E) and FIGS. 2(A) and 2(B), can be manufactured, for example, in mandrel extrusion, by properly designing the shape of a die or a mandrel, or by properly setting the attachment positions of the die and the mandrel during extrusion.

The Al alloy pipes of the present invention thus obtained have proper mechanical strength with excellent multistage formability, and they are preferable as structural members of transportation vehicles, such as automobiles. In particular, the Al alloy pipes shown in FIGS. 1(C) and 1(D) are effective for achieving fuel efficiency, as they are thin in thickness and lightweight.

The present invention is the Al alloy pipe which is composed of an Al alloy comprising Mg in a proper content, and Mn, Cr, and Ti, if necessary, and which has a 0.2% yield strength of 60 MPa or more and 160 MPa or less and an average crystal grain diameter of 150 μm or less, and which has an appropriate mechanical strength and excellent multistage formability. Accordingly, the Al alloy pipe of the present invention is preferable for use in structural members of transportation vehicles, such as automobiles, and it exhibits remarkable effects in view of industrial aspects.

The present invention will be described in more detail based on examples given below, but the invention is not meant to be limited by these examples.

EXAMPLES

Example 1

Cylindrical billets, of outer diameter 260 mm and inner diameter 102.5 mm, were formed by melt-casting of Al alloys (Alloy Nos. A to J) each having a composition within the range defined in the present invention, as shown in Table 1. After homogenizing the billets at 530° C. for 4 hours, the resultant billets were hot extruded (at an extrusion ratio of 47), by mandrel extrusion, into round cylindrical pipes of outer diameter 80 mm and thickness 4 mm. Then, the round cylindrical pipes were annealed at 360° C. for 2 hours, to manufacture Al alloy pipes (temper O).

The extrusion temperature was 490° C., and the extrusion speed was 5 m/minutes, in the above hot extrusion.

The thus-obtained Al alloy pipes (temper O) (Sample Nos. 1 to 10) were tested with respect to: (1) an average crystal grain diameter; (2) a distribution density of an intermetallic compound(s) with a maximum length of 5 μm or more; (3) mechanical properties; (4) multistage formability; and (5) repeated bending ability, according to the following methods.

(1) Each crystal grain diameter of five samples for one pipe was measured with respect to the both faces of the LT-ST face and the L-ST face, according to the cutting method prescribed in JIS H 0501. The average values are shown in Table 2 below.

(2) The distribution density of an intermetallic compound having a maximum length of 5 μm or more, was measured using an image analyzer coupled with an optical microscope. The measuring conditions were 0.4 μm in length per pixel, over an area of 0.17 $mm^2$. Both faces of the LT-ST face and the L-ST face were measured with five samples for each face. Average values thereof are shown in Table 2.

(3) To measure the mechanical properties (tensile strength, 0.2% yield strength, and elongation), No. 12B test pieces prescribed in JIS Z 2201 were cut out, and three samples of each were subjected to tensile testing, according to JIS Z 2241. The average values thereof are shown in Table 2.

Figure 4:
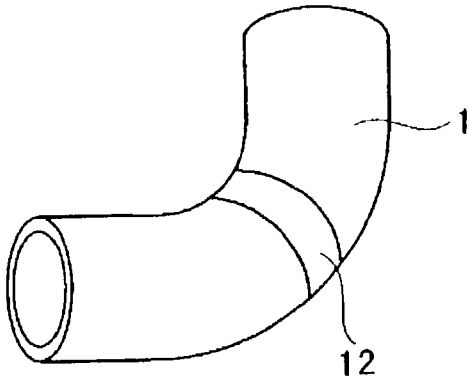
FIG. 4 is an illustrative view showing a sampling site of a test piece for the flattening test described below.
Figure 5:
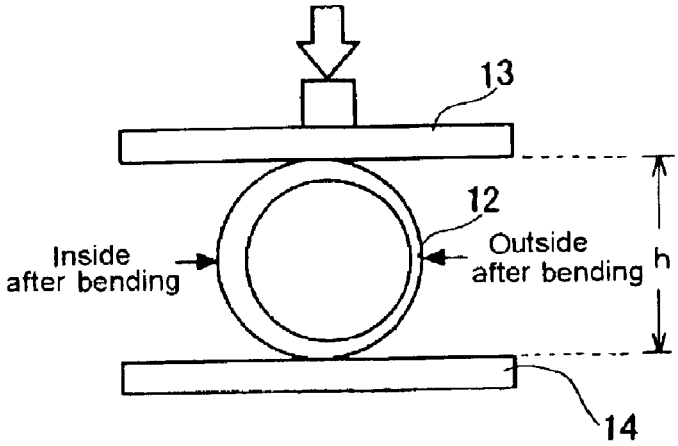
FIG. 5 is an illustrative view showing a method for measuring a flattening ratio.

The acceptable value for tensile strength is 165 MPa or more. The elongation is preferably 15% or more. (4) For the multistage formability test, the Al alloy pipe 1 was bent, as shown in FIG. 4, using a draw bender (bent radius, 150 mm; bent angle, 90 degrees). A test piece 12 was cut from the bent portion, and pressed in the manner as shown in FIG. 5, to measure a height h (mm) of the test piece 12 at which cracks occurred. The flattening ratio (flatness) L (L=(H−h)/H, in which H (mm) denotes the initial height of the test piece) was calculated. The average values (n=3) of the flattening ratio L are shown in Table 2. The flattening ratio of 60% or more was judged to pass the test, and the flattening ratio less than 60% was judged not to pass the test, respectively. In FIG. 5, the reference numeral 13 denotes a pressing plate, and the reference numeral 14 denotes a mounting plate.

Figure 6:
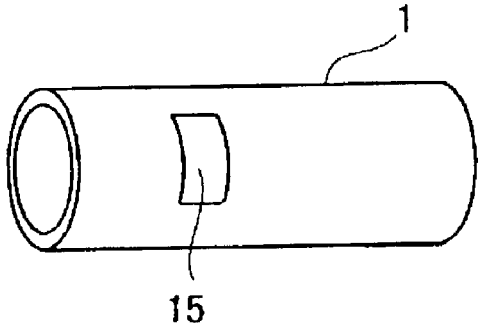
FIG. 6 is an illustrative view showing a sampling site of a test piece for the repeated bending test described below.
Figure 8:
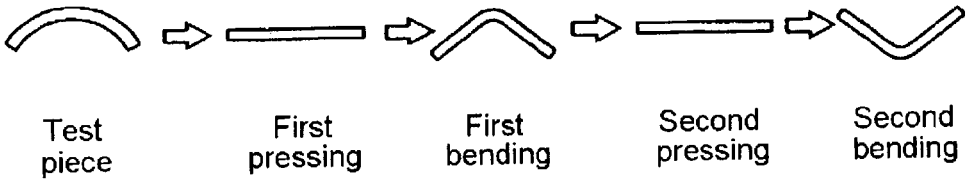
FIG. 8 is an illustrative view showing a pressed shape and bent shape of a test piece in the repeated bending test.

(5) For the repeated bending test, a test piece 15 was cut from the Al alloy pipe 1, as shown in FIG. 6, and it was subjected to repeated pressing and bending (see FIG. 8). A test piece that did not show any cracks in the first pressing, the first bending, the second pressing, and the second bending, was judged to pass the test, while a test piece that showed cracks was judged not to pass the test.

Table 2 shows the number of pressing or bending after which cracks occurred.

Figure 7:
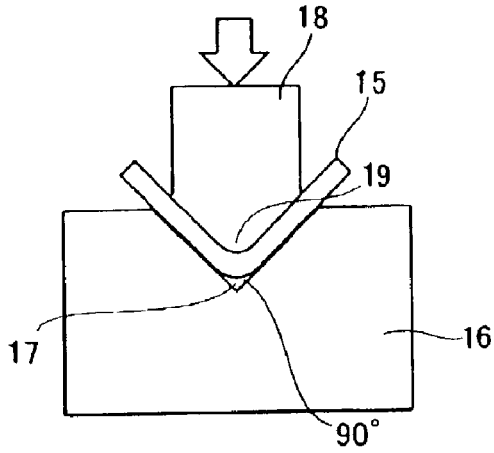
FIG. 7 is an illustrative view of bending.

The bending was carried out, as shown in FIG. 7, such that a test piece 15 was placed on a V-shaped groove 17 on the surface of a mounting table 16, and then the test piece was pressed with a pressing tool 18. The arrow in the drawing denotes the direction of pressing. A radius R of 9 mm was provided at a pressing edge 19 of the pressing tool 18.

With respect to the results in the above-tests, when a sample satisfied all of the following three conditions 1), 2) and 3), the sample was judged to pass the total evaluation of tests, which is denoted as "○" in Table 2. The conditions are: 1) the tensile strength was 165 MPa or more, 2) the flattening ratio was 60% or more, and 3) no cracks were occurred by the second bending in the repeated bending test. Contrary, when a sample failed to satisfy even any one among the conditions, the sample was judged not to pass the total evaluation of tests, which is denoted as "x" in Table 2.

Example 2

The alloy Nos. D, E, F, and I each were formed into an Al alloy pipe (H112 temper) in the same manner as in Example 1, except for not subjecting the hot-extruded round cylindrical pipe to annealing. To the thus-obtained H112-temper pipes, the same tests as in Example 1 were carried out (Sample Nos. 11 to 14).

Comparative Example 1

Al alloy pipes (temper O) were manufactured in the same manner as in Example 1, except that Al alloys (Alloy Nos. K to P) each having a composition outside of the range defined in the present invention, as shown in Table 1, were used. The thus-obtained pipe samples were subjected to the same tests as in Example 1 (Sample Nos. 15 to 20).

Comparative Example 2

Al alloy pipes (temper O) were manufactured in the same manner as in Example 1, except that a round cylindrical billet of Alloy E or F, of outer diameter 180 mm and inner diameter 102.5 mm, was used respectively, and that the extrusion ratio was set to be 18. The thus-obtained pipe samples were subjected to the same tests as in Example 1 (Sample Nos. 21 and 22).

Since the magnitude of strain (a working ratio) applied to these two Al alloy pipes in the extrusion step was small, due to a small diameter of the billet, it resulted a large average crystal grain diameter of recrystallized grains.

Comparative Example 3

Alloy No. B was formed into an Al alloy pipe (H112 temper) in the same manner as in Example 1, except for not subjecting the hot-extruded round cylindrical pipe to annealing. To the thus-obtained H112-temper pipe, the same tests as in Example 1 were carried out (Sample No. 23).

The test results in Examples 1 and 2, and Comparative Examples 1 to 3, are shown in Table 2.

TABLE 1

| Class. | Alloy No. | Mg | Si | Fe | Mn | Cr | Cu | Ti |
|---|---|---|---|---|---|---|---|---|
| Alloy as defined in this invention | A | 2.2 | 0.05 | 0.11 | 0.79 | 0.12 | 0.02 | 0.01 |
| | B | 3.4 | 0.07 | 0.09 | 0.31 | 0.09 | 0.01 | 0.01 |
| | C | 2.4 | 0.08 | 0.09 | 0.38 | 0.23 | 0.03 | 0.01 |
| | D | 2.6 | 0.07 | 0.12 | 0.04 | 0.31 | 0.01 | 0.01 |
| | E | 2.8 | 0.05 | 0.11 | 0.55 | 0.07 | 0.03 | 0.01 |
| | F | 2.9 | 0.09 | 0.14 | 0.38 | 0.33 | 0.01 | 0.01 |
| | G | 2.4 | 0.09 | 0.14 | 0.73 | 0.04 | 0.02 | 0.01 |
| | H | 2.8 | 0.09 | 0.15 | 0.71 | 0.31 | 0.01 | 0.01 |
| | I | 2.9 | 0.08 | 0.10 | 0.00 | 0.16 | 0.01 | 0.01 |
| | J | 3.4 | 0.07 | 0.10 | 0.00 | 0.17 | 0.00 | 0.01 |
| Alloy for comparison | K | 1.8 | 0.08 | 0.10 | 0.36 | 0.15 | 0.02 | 0.01 |
| | L | 5.4 | 0.07 | 0.12 | 0.78 | 0.14 | 0.02 | 0.01 |
| | M | 2.8 | 0.37 | 0.14 | 0.53 | 0.19 | 0.03 | 0.01 |
| | N | 2.6 | 0.08 | 0.54 | 0.55 | 0.11 | 0.02 | 0.01 |
| | O | 2.5 | 0.08 | 0.11 | 1.3 | 0.08 | 0.01 | 0.01 |
| | P | 2.7 | 0.07 | 0.12 | 0.14 | 0.48 | 0.01 | 0.01 |

(Note)

Unit: % by mass, with the balance of each alloy being Al and inevitable impurities.

TABLE 2

| Class. | Sample No. | Alloy No. | Diameter of billet (mm) | Temper | Ts (MPa) | 0.2% Ys (MPa) | El (%) | (1) Density of inter-metallic compound (number/mm$^2$) | Average crystal grain diameter (μm) | (2) Multistage formability | | (3) Total evaluation |
|---|---|---|---|---|---|---|---|---|---|---|---|---|
| | | | | | | | | | | Flattening ratio | Timing when cracks occurred | |
| Example 1 | 1 | A | 260 | O | 171 | 64 | 28.1 | 186 | 70 | 83 | 4th pressing | ○ |
| | 2 | B | 260 | O | 249 | 120 | 24.3 | 123 | 100 | 70 | 3rd bending | ○ |
| | 3 | C | 260 | O | 194 | 80 | 27.5 | 202 | 80 | 82 | 4th pressing | ○ |
| | 4 | D | 260 | O | 201 | 85 | 28.0 | 246 | 60 | 76 | 3rd bending | ○ |
| | 5 | E | 260 | O | 220 | 95 | 27.2 | 205 | 80 | 76 | 3rd bending | ○ |
| | 6 | F | 260 | O | 239 | 99 | 26.7 | 397 | 90 | 72 | 3rd bending | ○ |
| | 7 | G | 260 | O | 205 | 88 | 25.3 | 403 | 80 | 73 | 3rd bending | ○ |
| | 8 | H | 260 | O | 235 | 106 | 26.3 | 621 | 80 | 62 | 3rd pressing | ○ |
| | 9 | I | 260 | O | 203 | 86 | 28.2 | 232 | 70 | 77 | 3rd bending | ○ |
| | 10 | J | 260 | O | 228 | 100 | 28.0 | 176 | 70 | 78 | 3rd bending | ○ |
| Example 2 | 11 | D | 260 | H112 | 209 | 95 | 27.0 | 263 | 60 | 67 | 3rd bending | ○ |
| | 12 | E | 260 | H112 | 226 | 104 | 27.0 | 220 | 80 | 69 | 3rd bending | ○ |
| | 13 | F | 260 | H112 | 247 | 116 | 25.3 | 375 | 90 | 63 | 3rd bending | ○ |
| | 14 | I | 260 | H112 | 211 | 96 | 27.6 | 241 | 70 | 70 | 3rd bending | ○ |
| Comparative Example 1 | 15 | K | 260 | O | 162 | 57 | 28.6 | 162 | 80 | 84 | 4th pressing | X |
| | 16 | L | 260 | O | 310 | 184 | 24.6 | 239 | 90 | 54 | 2nd pressing | X |
| | 17 | M | 260 | O | 231 | 102 | 26.2 | 738 | 80 | 53 | 2nd pressing | X |
| | 18 | N | 260 | O | 210 | 94 | 27.2 | 821 | 70 | 56 | 2nd bending | X |
| | 19 | O | 260 | O | 231 | 108 | 24.8 | (4) 257 | 110 | 55 | 2nd pressing | X |
| | 20 | P | 260 | O | 207 | 96 | 26.7 | (4) 229 | 100 | 56 | 2nd bending | X |
| Comparative Example 2 | 21 | E | 180 | O | 227 | 94 | 25.2 | 196 | 230 | 55 | 2nd bending | X |
| | 22 | F | 180 | O | 237 | 99 | 24.5 | 252 | 260 | 54 | 2nd bending | X |
| Comparative Example 3 | 23 | B | 260 | H112 | 255 | 165 | 23.8 | 146 | 100 | 58 | 2nd bending | X |

(Note)
(1) Distribution density of an intermetallic compound having a maximum length of 5 μm or more
(2) Unit of the flattening ratio is %
(3) Total evaluation: "○", passed; X, not passed
(4) Occurred a giant intermetallic compound (initial crystals)

As is apparent from the results shown in Table 2, all the samples of the present invention (Nos. 1 to 14) were excellent in multistage formability. Sample Nos. 1 and 3 had a slightly low yield strength, and they were particularly excellent in multistage formability. The multistage formability of Sample No. 8 was at a slightly lower level as compared to other samples according to the present invention, since the distribution density of an intermetallic compound with a maximum length of 5 μm or more was high, due to higher contents of Si, Fe, Mn and Cr.

In contrast, the 0.2% yield strength of Sample No. 15 of the comparative example was lower than the prescribed value defined in the present invention, due to a too small content of Mg. The 0.2% yield strength was too high, and multistage formability was poor, in Sample Nos. 16 and 23 of the comparative examples, because the content of Mg in the former sample was too high, and the latter sample was not annealed.

Giant intermetallic compounds (primary crystals) were formed, and multistage formability was poor, in Sample Nos. 19 and 20 of the comparative examples, because the content of Mn was too high in the former sample, and the content of Cr was too high in the latter. The distribution density of an intermetallic compound with a maximum length of 5 μm or more exceeded 500/mm$^2$, and multistage formability was poor, in Sample Nos. 17 and 18 of the comparative examples, because the content of Si was too high in the former sample, and the content of Fe was too high in the latter.

The crystal grain diameter was too large, and multistage formability was poor, in Sample Nos. 21 and 22 of the comparative examples, due to a small extrusion ratio.

It was found, from results in separate tests, that Sample Nos. 2 and 10 according to the present invention, and Sample No. 16 of the comparative example, which each were high in Mg content, were at a lower level on resistance against stress corrosion cracking. Among these, the resistance of Sample Nos. 2 and 10 according to the present invention was sufficient for practical use, but that of Sample No. 16 was impractical.

Example 3

Al alloys (Alloy Nos. a to j) each having a composition within the range defined in the present invention, as shown in Table 3, were melted and cast into round cylindrical billets, respectively. These billets were drilled at the center, to form tubular billets. After homogenization and re-heating of the billets, according to extrusion using a mandrel, a plurality of Al alloy pipes with a rectangular cross-sectional shape as shown in FIG. 1(A) (a major side length, 86 mm; a minor side length, 74 mm; a thickness, 6 mm; H112 temper), were manufactured, respectively. The billets were homogenized at 540° C. for 3 hours, and extruded under the conditions at a re-heating temperature (extrusion temperature) of 500° C., with an extrusion ratio of 35.

Then, each pipe was stretched with a stretcher. Some of the Al alloy pipes, immediately after stretching, were annealed at 360° C. for 2 hours (temper: O).

The thus-obtained Al alloy pipes were tested for the crystal grain diameter, the distribution density of an intermetallic compound with a maximum length of 5 μm or more, and the mechanical properties, in the same manner as in Example 1 (Sample Nos. 31 to 41).

The Al alloy pipes were also tested for bulge formability, by the following method.

Test samples were prepared by cutting the Al alloy pipes into lengths of 1000 mm, and the samples were bent, with a bent radius (radius of the inner side) of 150 mm and a bent angle of 45 degrees (see FIG. 9), using a draw bender. Each of the pipes was bent with the draw bender so that the side 2 of the Al alloy pipe 1 would come to the outside, as shown in FIG. 1(A).

Then, the Al alloy pipes, after bending, were respectively placed in a die of a hydraulic bulge forming machine, and then enlarged, by applying an inner pressure, until cracks were occurred.

Figure 9:
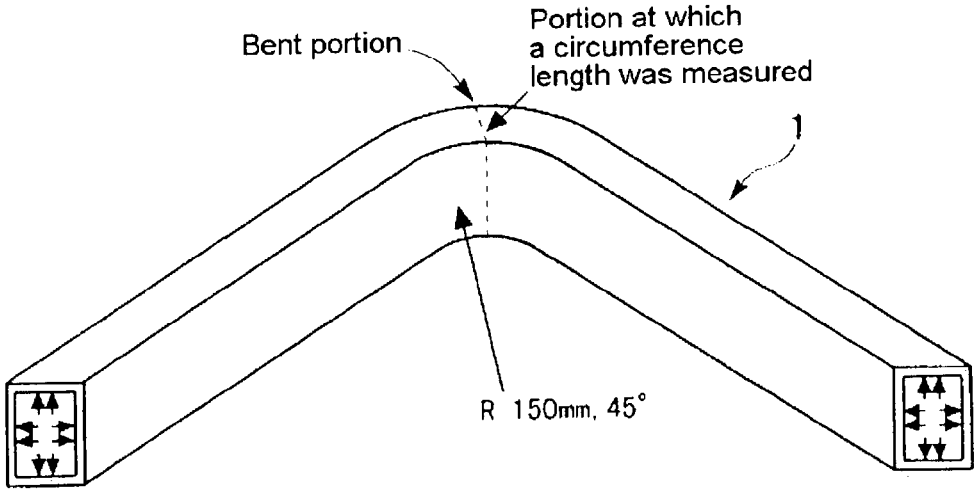
FIG. 9 is an illustrative view showing a rate of increment of circumference length at the bent portion in hydraulic bulge forming.

The circumference length (outer circumference length) of the bent portion, as shown in FIG. 9, was measured before and after the application of the inner pressure, and the rate R, of the increment of the circumference length, was calculated according to the following equation. A larger rate of increment of circumference length means better bulge formability. A rate of increment of circumference length of less than 10% means that the pipe is associated with poor bulge formability and impracticality.

$$R(\%)=[(L_2-L_1)/L_1]\times 100$$

wherein $L_2$ denotes the circumference length of the bent portion after occurrence of cracks, and $L_1$ denotes the circumference length of the bent portion before applying the inner pressure.

With respect to the results in the above-tests, when a sample satisfied all of the following two conditions 1) and 2), the sample was judged to pass the total evaluation of tests, which is denoted as "○" in Table 4. The conditions are: 1) the tensile strength was 165 MPa or more, and 2) the rate of increment of circumference length was 10% or more. Contrary, when a sample failed to satisfy even any one among the conditions, the sample was judged not to pass the total evaluation of tests, which is denoted as "x" in Table 4.

Example 4

A plurality of Al alloy pipes of any of the cross-sectional shapes shown in FIGS. 1(B) to 1(E), were respectively manufactured using Alloy No. d shown in Table 3 (having a composition within the range defined in the present invention), in the same manner as in Example 3 (H112), and the thus-obtained pipes were tested in the same manner as in Example 3 (Sample Nos. 42 to 45).

Bending with the draw bender was carried out such that the side 2 of each of the Al alloy pipes would come to the outside, as shown in FIGS. 1(B) to 1(E), respectively.

Example 5

A plurality of Al alloy pipes of any of the cross-sectional shapes shown in FIGS. 2(A) and 2(B), were respectively manufactured using Alloy No. d shown in Table 3 (having a composition within the range defined in the present invention), in the same manner as in Example 3 (H112), and the thus-obtained pipes were tested in the same manner as in Example 3 (Sample Nos. 46 and 47).

Bending with the draw bender was carried out such that the side, on which the flange 6 was provided, of each of the Al alloy pipes would come to the outside, as shown in FIGS. 2(A) and 2(B), respectively.

Example 6

A hot-rolled sheet of thickness 6 mm, of Alloy No. d as shown in Table 3 (having a composition within the range defined in the present invention), was rolled up and electrically welded at the edges fitted each other. Then, the thus-obtained welded pipe was subjected to roller-forming, thereby an Al alloy pipe (seam-welded pipe) having the same cross-sectional shape as in Example 3 was manufactured. The resultant pipe was tested in the same manner as in Example 3 (Sample No. 48). The cross-sectional shape and the position of fused portion (welded portion) of the Al alloy pipe were the same as those shown in FIG. 3(A).

Example 7

A billet of Alloy No. d as shown in Table 3 (having a composition within the range defined in the present invention), was extruded using a port hole die having four ports, thereby an Al alloy pipe having the same cross-sectional shape as in Example 3 was manufactured. The resultant pipe was tested in the same manner as in Example 3 (Sample No. 49). The cross-sectional shape and the positions of fused portions (welded portions) of the Al alloy pipe were the same as those shown in FIG. 3(B).

Comparative Example 4

Al alloy pipes each having a rectangular cross-sectional shape were manufactured in the same manner as in Example 3 (temper H112), except that Alloy Nos. k, l and m, each having a composition outside of the range defined in the present invention, as shown in Table 3, were used, respectively. The thus-obtained pipe samples were subjected to the same tests as in Example 3 (Sample Nos. 50 to 52).

Comparative Example 5

An Al alloy pipe having a rectangular cross-sectional shape was manufactured in the same manner as in Example 3 (temper H112), except that the Alloy No. j, having a composition within the range defined in the present invention, as shown in Table 3, was used. The thus-obtained pipe sample was subjected to the same tests as in Example 3 (Sample No. 53).

The test results in Examples 3 to 7 and Comparative Examples 4 and 5 are shown in Table 4.

TABLE 3

| Class. | Alloy No. | Mg | Si | Fe | Mn | Cr | Cu | Ti |
|---|---|---|---|---|---|---|---|---|
| Alloy as defined in this invention | a | 2.3 | 0.05 | 0.11 | 0.00 | 0.00 | 0.03 | 0.01 |
| | b | 2.7 | 0.07 | 0.09 | 0.54 | 0.09 | 0.01 | 0.02 |
| | c | 2.8 | 0.08 | 0.09 | 0.22 | 0.23 | 0.02 | 0.03 |
| | d | 2.6 | 0.07 | 0.12 | 0.58 | 0.12 | 0.01 | 0.03 |
| | e | 2.8 | 0.05 | 0.11 | 0.61 | 0.03 | 0.02 | 0.01 |
| | f | 2.9 | 0.09 | 0.11 | 0.63 | 0.27 | 0.02 | 0.03 |
| | g | 3.0 | 0.09 | 0.14 | 0.03 | 0.16 | 0.03 | 0.01 |
| | h | 3.4 | 0.03 | 0.08 | 0.02 | 0.16 | 0.02 | 0.01 |
| | i | 3.9 | 0.08 | 0.10 | 0.36 | 0.15 | 0.02 | 0.01 |
| | j | 4.6 | 0.07 | 0.12 | 0.28 | 0.13 | 0.04 | 0.02 |
| Alloy for comparison | k | 1.8 | 0.10 | 0.16 | 0.05 | 0.03 | 0.03 | 0.01 |
| | l | 5.8 | 0.08 | 0.14 | 0.61 | 0.23 | 0.02 | 0.05 |
| | m | 2.9 | 0.08 | 0.11 | 1.23 | 0.65 | 0.01 | 0.23 |

(Note)

Unit: % by mass, with the balance of each alloy being Al and inevitable impurities.

TABLE 4

| Class. | Sample No. | Alloy No. | Cross-sectional shape of Al alloy pipe | Manufacturing method | Temper | Ts (MPa) | 0.2% Ys (MPa) | El (%) | (1) Density of intermetallic compound (number/mm$^2$) | Average crystal grain diameter (μm) | Welded portion | Rate of increment of circumference length (%) | (2) Total evaluation |
|---|---|---|---|---|---|---|---|---|---|---|---|---|---|
| Example 3 | 31 | a | FIG. 1(A) | Mandrel extrusion | O | 195 | 67 | 28 | 95 | 85 | None | 12.5 | ○ |
| | 32 | a | FIG. 1(A) | Mandrel extrusion | H112 | 230 | 80 | 29 | 92 | 85 | None | 12.9 | ○ |
| | 33 | b | FIG. 1(A) | Mandrel extrusion | H112 | 224 | 102 | 26 | 152 | 65 | None | 11.8 | ○ |
| | 34 | c | FIG. 1(A) | Mandrel extrusion | O | 243 | 103 | 28 | 160 | 53 | None | 12.0 | ○ |
| | 35 | d | FIG. 1(A) | Mandrel extrusion | H112 | 252 | 109 | 35 | 229 | 65 | None | 12.3 | ○ |
| | 36 | e | FIG. 1(A) | Mandrel extrusion | H112 | 260 | 110 | 34 | 223 | 55 | None | 11.8 | ○ |
| | 37 | f | FIG. 1(A) | Mandrel extrusion | O | 256 | 112 | 33 | 345 | 50 | None | 12.0 | ○ |
| | 38 | g | FIG. 1(A) | Mandrel extrusion | H112 | 260 | 116 | 32 | 133 | 62 | None | 12.7 | ○ |
| | 39 | h | FIG. 1(A) | Mandrel extrusion | O | 266 | 113 | 28 | 167 | 70 | None | 11.4 | ○ |
| | 40 | i | FIG. 1(A) | Mandrel extrusion | O | 271 | 123 | 25 | 290 | 76 | None | 11.0 | ○ |
| | 41 | j | FIG. 1(A) | Mandrel extrusion | O | 280 | 135 | 18 | 365 | 55 | None | 11.9 | ○ |
| Example 4 | 42 | d | FIG. 1(B) | Mandrel extrusion | H112 | 255 | 110 | 34 | 232 | 60 | None | 15.8 | ○ |
| | 43 | d | FIG. 1(C) | Mandrel extrusion | H112 | 254 | 111 | 32 | 233 | 57 | None | 12.1 | ○ |
| | 44 | d | FIG. 1(D) | Mandrel extrusion | H112 | 258 | 108 | 35 | 219 | 61 | None | 12.0 | ○ |
| | 45 | d | FIG. 1(E) | Mandrel extrusion | H112 | 256 | 112 | 33 | 226 | 57 | None | 15.2 | ○ |
| Example 5 | 46 | d | FIG. 2(A) | Mandrel extrusion | H112 | 255 | 110 | 31 | 234 | 64 | None | 12.9 | ○ |
| | 47 | d | FIG. 2(B) | Mandrel extrusion | H112 | 256 | 109 | 35 | 221 | 65 | None | 12.8 | ○ |
| Example 6 | 48 | d | FIG. 3(A) | Seam welding | O | 258 | 103 | 29 | 210 | 50 | Existing | 10.3 | ○ |
| Example 7 | 49 | d | FIG. 3(B) | Porthole extrusion | H112 | 260 | 113 | 31 | 210 | 70 | Existing | 10.6 | ○ |

TABLE 4-continued

| Class. | Sample No. | Alloy No. | Cross-sectional shape of Al alloy pipe | Manufacturing method | Temper | Ts (MPa) | 0.2% Ys (MPa) | El (%) | (1) Density of intermetallic compound (number/mm$^2$) | Average crystal grain diameter (μm) | Welded portion | Rate of increment of circumference length (%) | (2) Total evaluation |
|---|---|---|---|---|---|---|---|---|---|---|---|---|---|
| Comparative Example 4 | 50 | k | FIG. 1(A) | Mandrel extrusion | H112 | 145 | 45 | 38 | 102 | 79 | None | 13.0 | X |
| | 51 | l | FIG. 1(A) | Mandrel extrusion | H112 | 328 | 185 | 11 | 330 | 60 | None | 7.8 | X |
| | 52 | m | FIG. 1(A) | Mandrel extrusion | H112 | 289 | 140 | 18 | 795 | 45 | None | 7.0 | X |
| Comparative Example 5 | 53 | j | FIG. 1(A) | Mandrel extrusion | H112 | 312 | 172 | 8 | 365 | 45 | None | 7.0 | X |

(Note)
(1) Distribution density of an intermetallic compound having a maximum length of 5 μm or more
(2) Total evaluation "○", passed; "X", not passed As is apparent from the results shown in Table 4, all of the Sample Nos. 31 to 41 in Example 3 according to the present invention each showed a rate of increment of circumference length at the bent portion of 10% or more before occurrence of cracks in the hydraulic bulge forming, and exhibited excellent multistage formability, i.e. the ability in bending→bulge forming.

In Sample No. 42 in Example 4, the thickness of the side 2 that would come to the outside after bending (FIG. 1(B)), was larger than the thickness of the side 3 that would come to the inside after bending. Consequently, the rate of increment of circumference length at the bent portion in Sample No. 42 was larger than Sample No. 35 having the sides 2 and 3 equivalent in thickness. Since, in Sample No. 43, the thickness of the side 3 that would come to the inside after bending was small (FIG. 1(C)), and in sample No. 44, the thickness of the sides 4 and 4 that would come to both right and left sides after bending was small (FIG. 1(D)), the rates of increment of circumference length at the bent portion in these samples each were approximately the same as that of Sample No. 35 having the sides (the sides 2 and 3, as well as those corresponding to the side 4) equivalent in thickness. Consequently, Sample Nos. 43 and 44 were lightweight in accordance with the small thickness of the sides. Since, in Sample No. 45, the length of the side 2 that would come to the outside after bending (FIG. 1(E)) was longer than the length of the side 3 that would come to the inside after bending, the rate of increment of circumference length at the bent portion was improved, compared with Sample No. 35 having the sides 2 and 3 equivalent in thickness.

In Sample Nos. 46 and 47 in Example 5, since a flange was respectively provided at the outside or inside of the Al alloy pipes, wrinkling after bending was suppressed from occurring, enabling a beautiful outer appearance to be exhibited. A washer hole could be provided on the flange in Sample No. 46.

Cracks were occurred by the hydraulic bulge forming at the welded portion(s) in Sample 48 in Example 6 and in Sample No. 49 in Example 7, each having a welded portion(s). While the rate of increment of circumference length decreased in these samples, compared with the samples in Example 3 having no welded portions, the degree of decrease was practically acceptable.

Sample Nos. 42 and 45 were quite good in total evaluation.

On the contrary, the mechanical strength of Sample No. 50 in Comparative Example 4 was poor, due to a too low content of Mg. The rates of increment of circumference length were poor in Sample Nos. 51 and 52 in Comparative Example 4, since Sample No. 51 was readily cracked due to a too high content of Mg, and the content of intermetallic compound was increased in Sample No. 52, due to too large contents of Mn, Cr and Ti.

The rate of increment of circumference length was poor in Sample No. 53 in Comparative Example 5, because the 0.2% yield strength was too high. Although Sample No. 53 in Comparative Example 5 had the alloy composition within the range as defined in the present invention, the Mg content was approximately the upper limit. When the Al alloy pipe was manufactured as in Sample No. 53 using an H112-temper alloy without subjecting to annealing, the resultant pipe had a too high 0.2% yield strength. Therefore, if the Mg content is an amount as high as in Sample No. 53, 0.2% yield strength of a resulting pipe can be controlled to be within the range as defined in the present invention by, for example, controlling the manufacturing conditions appropriately such that an O-temper alloy could be obtained.

Having described our invention as related to the present embodiments, it is our intention that the invention not be limited by any of the details of the description, unless otherwise specified, but rather be construed broadly within its spirit and scope as set out in the accompanying claims.

What is claimed is:

1. An aluminum alloy pipe, which is composed of an aluminum alloy comprising 2.0% (% by mass, the same hereinafter) to 3.0% of Mg,
0.20% or less of Si,
0.30% or less of Fe,
0.8% or less (including 0%) of Mn,
0.35% or less (including 0%) of Cr, and
0.2% or less (including 0%) of Ti,
with the balance being Al and inevitable impurities,
wherein the aluminum alloy pipe has no welded portion,
wherein the aluminum alloy pipe has a 0.2% yield strength of 60 MPa or more and 160 MPa or less and an average crystal grain diameter of 150 μm or less, and wherein the aluminum alloy pipe has multistage formability.

2. The aluminum alloy pipe according to claim 1, wherein a distribution density of an intermetallic compound with a maximum length of 5 μm or more is 500/mm$^2$ or less.

3. The aluminum alloy pipe according to claim 1, wherein a thickness of a pipe wall at a portion that comes to the outside after bending is larger than a thickness of a pipe wall at a portion that comes to the inside after bending, in a cross section of the pipe in a pipe's circumference direction.

4. The aluminum alloy pipe according to claim 1, wherein a wall surface that comes to the inside after bending, and a wall surface that comes to the outside after bending, each have an approximately linear side, and wherein a length of the side at a portion that comes to the outside after bending, is longer than a length of the side at a portion that comes to the inside after bending, in a cross section of the pipe in a pipe's circumference direction.

5. The aluminum alloy pipe according to claim 1, which is flanged.

6. An aluminum alloy pipe, which is composed of an aluminum alloy comprising 2.0% to 3.0% of Mg,
0.10% or less of Si,
0.15% or less of Fe,
0.8% or less (including 0%) of Mn,
0.35% or less (including 0%) of Cr, and
0.2% or less (including 0%) or Ti,
with the balance being Al and inevitable impurities,
wherein the aluminum alloy pipe has no welded portion,
wherein the aluminum alloy pipe has a 0.2% yield strength of 60 MPa or more and 140 MPa or less and an average crystal grain diameter of 150 μm or less, and
wherein the aluminum alloy pipe has multistage formability.

7. The aluminum alloy pipe according to claim 6, wherein a distribution density of an intermetallic compound with a maximum length of 5 μm or more is 500/mm$^2$ or less.

8. The aluminum alloy pipe according to claim 6, wherein a thickness of a pipe wall at a portion that comes to the outside after bending is larger than a thickness of a pipe wall at a portion that comes to the inside after bending, in a cross section of the pipe in a pipe's circumference direction.

9. The aluminum alloy pipe according to claim 6, wherein a wall surface that comes to the inside after bending, and a wall surface that comes to the outside after bending, each have an approximately linear side, and wherein a length of the side at a portion that comes to the outside after bending, is longer than a length of the side at a portion that comes to the inside after bending, in a cross section of the pipe in a pipe's circumference direction.

10. The aluminum alloy pipe according to claim 6, which is flanged.

11. An aluminum alloy pipe, which is composed of an aluminum alloy comprising 2.0% (% by mass, the same hereinafter) to 3.0% of Mg,
0.20% or less of Si,
0.30% or less of Fe,
0.8% or less (including 0%) of Mn,
0.35% or less (including 0%) of Cr, and
0.2% or less (including 0%) of Ti,
with the balance being Al and inevitable impurities,
wherein the aluminum alloy pipe has no welded portion,
wherein the aluminum alloy pipe has a 0.2% yield strength of 60 MPa or more and 160 MPa or less and an average crystal grain diameter of 150 μm or less, and
wherein the aluminum alloy pipe has multistage formability;
wherein the test to determine multistage formability is:
bending a sample of the alloy using a draw bender of 150 mm bend radius and 90 degrees bend angle;
hot mandrel extruding the alloy at an extrusion ratio of 47 at 490° C. and 5 m/minute into round cylindrical pipes of outer diameter 80 mm and thickness 4 mm;
annealing the cylindrical pipes 360° C. for 2 hours;
bending the alloy pipe using a draw bender of 150 mm bend radius and 90 degree bend angle;
cutting a test piece from the bent portion,
pressing the test piece to measure a height h (mm) of the test piece at which cracks occur; calculating flattening ratio L=(H−h)/H, wherein H (mm) denotes the initial height of the test piece;
and determining that a sample has multistage formability when a sample has a flattening ratio of 60% or greater.

12. The aluminum alloy pipe according to claim 11, wherein a distribution density of an intermetallic compound with a maximum length of 5 μm or more is 500/mm$^2$ or less.

13. The aluminum alloy pipe according to claim 11, wherein a thickness of a pipe wall at a portion that comes to the outside after bending is larger than a thickness of a pipe wall at a portion that comes to the inside after bending, in a cross section of the pipe in a pipe's circumference direction.

14. The aluminum alloy pipe according to claim 11, wherein a wall surface that comes to the inside after bending, and a wall surface that comes to the outside after bending, each have an approximately linear side, and wherein a length of the side at a portion that comes to the outside after bending, is longer than a length of the side at a portion that comes to the inside after bending, in a cross section of the pipe in a pipe's circumference direction.

15. The aluminum alloy pipe according to claim 11, which is flanged.

16. An aluminum alloy pipe, which is composed of an aluminum alloy comprising 2.0% to 3.0% of Mg,
0.10% or less of Si,
0.15% or less of Fe,
0.8% or less (including 0%) of Mn,
0.35% or less (including 0%) of Cr, and
0.2% or less (including 0%) or Ti,
with the balance being Al and inevitable impurities,
wherein the aluminum alloy pipe has a 0.2% yield strength of 60 MPa or more and 140 MPa or less and an average crystal grain diameter of 150 μm or less,
wherein the aluminum alloy pipe has no welded portion, and
wherein the aluminum alloy pipe has multistage formability;
wherein the test to determine multistage formability is:
bending a sample of the alloy using a draw bender of 150 mm bend radius and 90 degrees bend angle;
hot mandrel extruding the alloy at an extrusion ratio of 47 at 490° C. and 5 m/minute into round cylindrical pipes of outer diameter 80 mm and thickness 4 mm;
annealing the cylindrical pipes 360° C. for 2 hours;
bending the alloy pipe using a draw bender of 150 mm bend radius and 90 degree bend angle;
cutting a test piece from the bent portion,
pressing the test piece to measure a height h (mm) of the test piece at which cracks occur; calculating flattening ratio L=(H−h)/H, wherein H (mm) denotes the initial height of the test piece;
and determining that a sample has multistage formability when a sample has a flattening ratio of 60% or greater.

17. The aluminum alloy pipe according to claim 16, wherein a distribution density of an intermetallic compound with a maximum length of 5 μm or more is 500/mm$^2$ less.

18. The aluminum alloy pipe according to claim 16, wherein a thickness of a pipe wall at a portion that comes to the outside after bending is larger than a thickness of a pipe wall at a portion that comes to the inside after bending, in a cross section of the pipe in a pipe's circumference direction.

19. The aluminum alloy pipe according to claim 16, wherein a wall surface that comes to the inside after bending, and a wall surface that comes to the outside after bending, each have an approximately linear side, and wherein a length of the side at a portion that comes to the outside after bending, is longer than a length of the side at a portion that comes to the inside after bending, in a cross section of the pipe in a pipe's circumference direction.

20. The aluminum alloy pipe according to claim 16, which is flanged.

* * * * *